US007321303B2

(12) United States Patent
Chen

(10) Patent No.: US 7,321,303 B2
(45) Date of Patent: Jan. 22, 2008

(54) REMOTE SURVEILLANCE DEVICE

(76) Inventor: Hsin Chen, 6F, No. 167, Sec. 1, Hsin Min St., Tan Shui Chen, Taipei Hsien (TW)

( * ) Notice: Subject to any disclaimer, the term of this patent is extended or adjusted under 35 U.S.C. 154(b) by 199 days.

(21) Appl. No.: 11/242,846

(22) Filed: Oct. 5, 2005

(65) Prior Publication Data

US 2007/0075855 A1 Apr. 5, 2007

(51) Int. Cl.
*G08B 13/00* (2006.01)

(52) U.S. Cl. ..... 340/541; 340/539.31; 340/693.1; 340/693.5; 348/152

(58) Field of Classification Search ..... 340/541, 340/539.1, 539.31, 539.16, 539.17, 693.1, 340/693.2, 693.5; 348/143, 152, 159
See application file for complete search history.

(56) References Cited

U.S. PATENT DOCUMENTS 4,978,942 A * 12/1990 Bruce ..... 340/556
5,198,799 A * 3/1993 Pascale ..... 340/556
6,052,052 A * 4/2000 Delmonaco ..... 340/539.11
6,087,938 A * 7/2000 Gitelis et al. ..... 340/539.1
6,118,375 A * 9/2000 Duncan ..... 340/541
6,424,371 B1 * 7/2002 Wen ..... 348/153
6,709,172 B2 * 3/2004 Brown ..... 348/143
6,778,093 B2 * 8/2004 Harwood ..... 340/693.1

* cited by examiner

*Primary Examiner*—Thomas Mullen
(74) *Attorney, Agent, or Firm*—Leong C. Lei

(57) ABSTRACT

A remote surveillance device is provided herein, which mainly contains a camera, infra-red LEDs, an anti-theft circuit, a radio-frequency transmission circuit, a solar panel, and a battery, etc. The remote surveillance device is operable during power outage, saves captured images locally, transmits captured images to at least a remote control center via a wireless air interface, generates alarm and notifies a control center whenever an abnormal condition occurs. The infra-red LEDs provides lighting for continuous image capturing during night time.

2 Claims, 7 Drawing Sheets

REMOTE SURVEILLANCE DEVICE

BACKGROUND OF THE INVENTION (a) Technical Field of the Invention

The present invention generally relates to surveillance devices and, more particularly, to a surveillance device having night vision and un-interruptible power supply capable of remotely transmitting images and alarms.

(b) Description of the Prior Art

As illustrated in FIG. 1A, a conventional surveillance system mainly contains at least a surveillance device 11 powered by the mains 121. The images captured by the surveillance device 11 are transmitted to a monitor device 13 of the surveillance system via a cable 12. The monitor device 13 then stores the received images onto a tape, a hard disk drive, or other storage device. The surveillance device 11, as illustrated in FIG. 1B, contains a main body 20, a protection housing 112, and a camera 222, and is usually mounted on a stand 113 at the monitored site. FIG. 1C shows another surveillance device 11, whose main body 20 contains a circuit board 223 and a casing 224. Basically, image capturing only requires the circuit board 223 and the camera 222. The rest of the components such as the casing, protection housing, stand, and cables are only for transmitting the captured images for monitoring or storage. These conventional surveillance systems have a number of disadvantages. For example, in order to conduct remote surveillance, cables have to be extended, underground or overground, even up to miles of distance to a control center. This renders the cables vulnerable for theft, man-made damage, or natural disaster. In addition, the conventional surveillance devices usually are not equipped with un-interruptible power supply and any anti-theft mechanism to guard against power outage, theft, and artificial destruction. Further more, usually multiple surveillance devices are connected to a single monitor device. If more monitor devices are desired for backup or concurrent monitoring purpose, the cabling not only is complex, but also requires tremendous effort.

SUMMARY OF THE INVENTION

The primary purpose of the present invention is to provide a remote surveillance device that can transmit the captured images to multiple monitor devices at different locations, issue alarms to a control center when abnormal conditions occur, all via wireless signals, and continue to operate and store captured images locally even under power outage for future retrieval.

The remote surveillance device converts the captured images into digitized data, and transmits the digitized data to any one of multiple control centers located at geographically distributed locations for remote monitoring by an appropriate radio-frequency protocol such as GPRS, GSM, etc.

The remote surveillance device captures images by a CCD (charge coupled device) camera. The remote surveillance device is also equipped with a number of infra-red (IR) light emitting diodes (LEDs) so that IR-based image capture could be conducted during the night or when there is not enough lighting.

The remote surveillance device is powered by the mains under normal circumstances and automatically switches to use an internal battery when the electricity from the mains is disrupted. The remote surveillance device has a solar panel which continues to charge the battery when the mains is not available.

The remote surveillance device is also equipped with an anti-theft circuit which would generate alarms when an abnormal condition such as power outage, housing being forcibly opened, dismantled, etc. occurs.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1A:
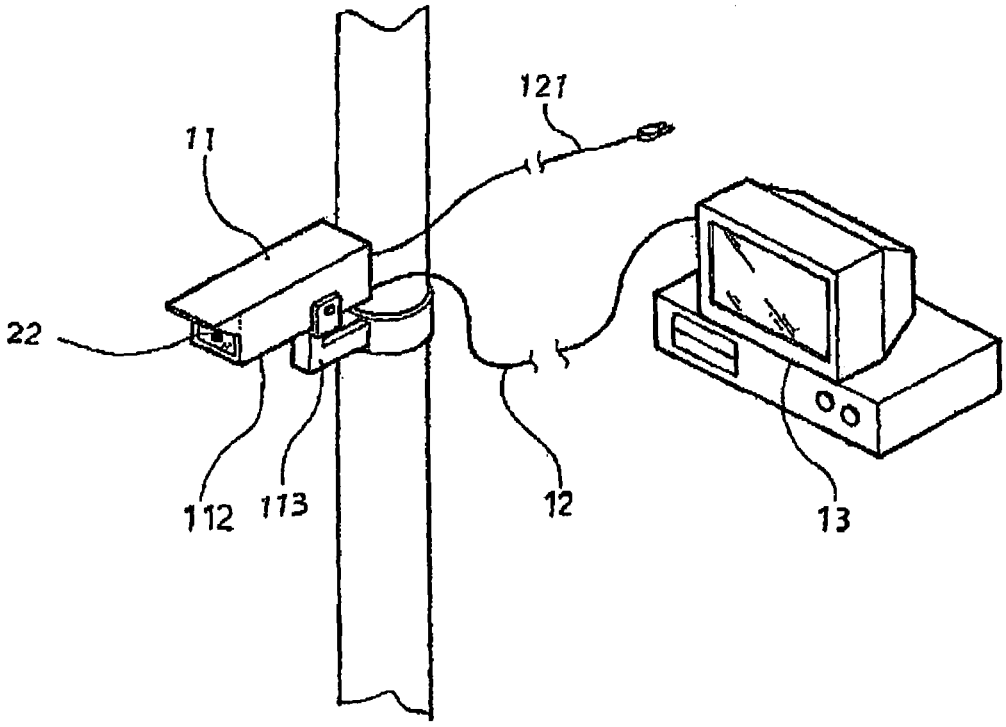
PRIOR ART FIG. 1A
FIG. 1A is a schematic diagram showing an application scenario of a conventional surveillance system.
Figure 1B:
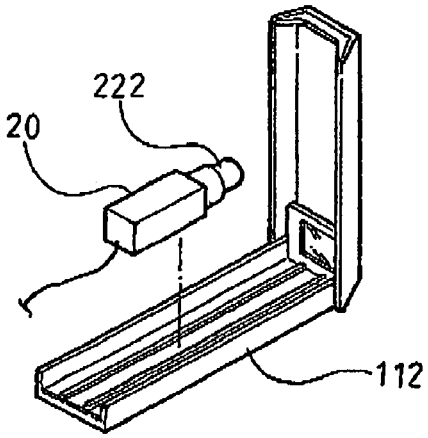
PRIOR ART FIG. 1B
FIGS. 1B and 1C are perspective views showing two conventional surveillance devices.
Figure 1C:
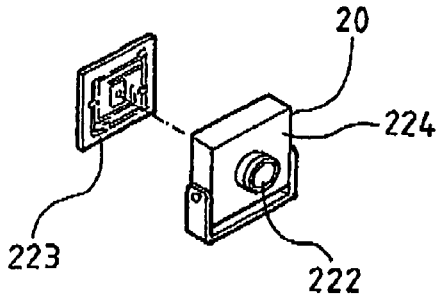
PRIOR ART FIG. 1C
Figure 2:
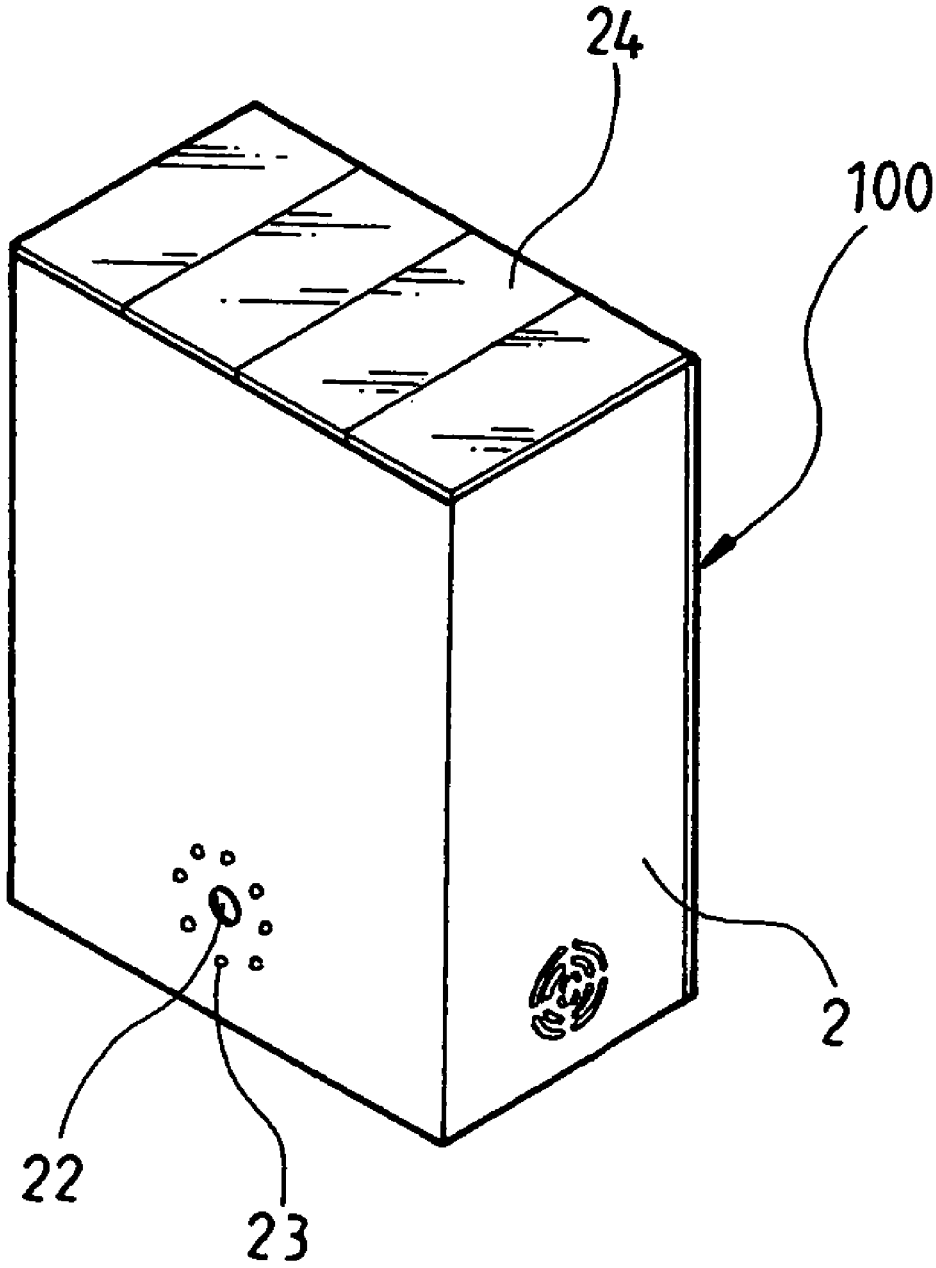
FIG. 2 is a perspective view showing the appearance of a remote surveillance device according to an embodiment of the present invention.
Figure 3:
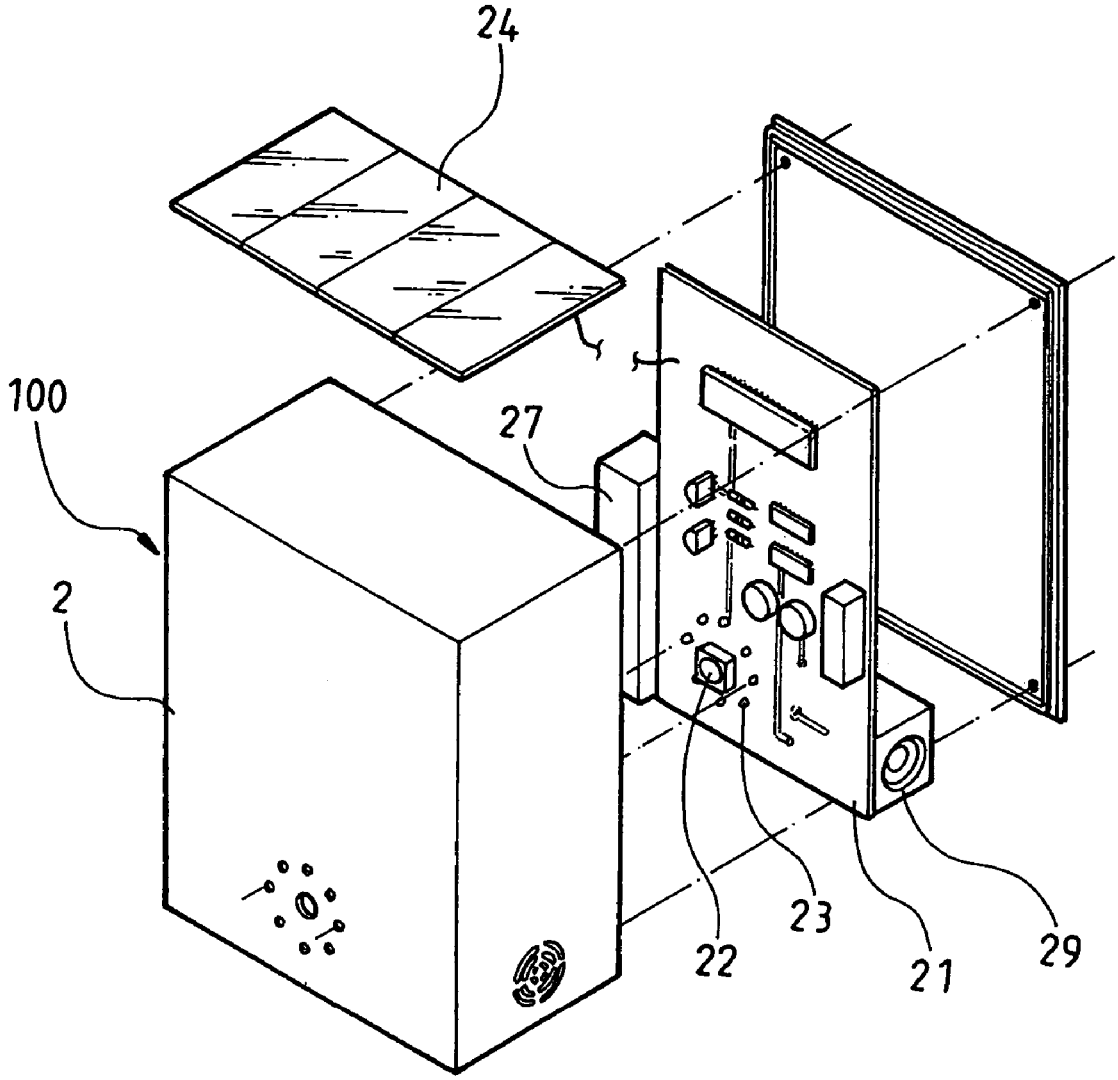
FIG. 3 is a perspective view showing the various components of a remote surveillance device according to an embodiment of the present invention.
Figure 4:
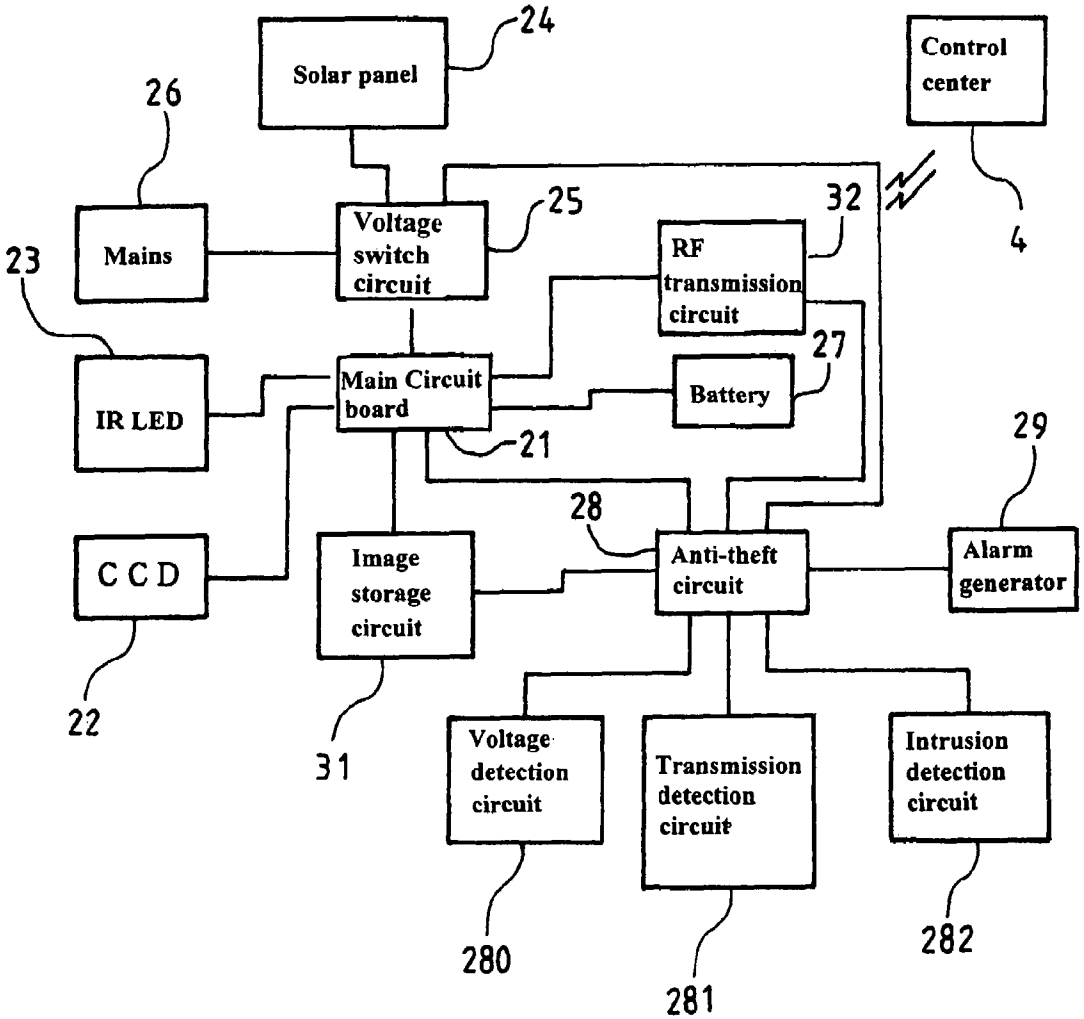
FIG. 4 is a functional diagram showing the various components of a remote surveillance device according to an embodiment of the present invention.

As shown in FIGS. 2~4, a surveillance device 100 according to an embodiment of the present invention has a main circuit board 21 connected to a CCD camera 22, both configured inside a housing 2. Around the CCD camera 22, there are multiple IR LEDs 23 for lighting during the night or when there is not enough lighting in the monitored environment.

The surveillance device 110 has a solar panel 24 configured on top of the housing 2. The solar panel 24 is connected to a voltage switch circuit 25, which is in turn connected to the mains 26. Under normal condition, the voltage switch circuit 25 allows the main circuit board 21 to draw electricity from the mains 26, and to charge a battery 27 connected to the main circuit board 21. If electricity is not available from the mains 26 because of power outage or whatever reason, the main circuit board 21 would continue to function from the electricity stored in the battery 27, while the voltage switch circuit 25 would automatically switch to allow the solar panel 24 to charge the battery 27.

The main circuit board 21 is connected to an anti-theft circuit 28, which is in turn connected to intrusion detection circuit 282. When the housing 2 is forcibly opened, or dismantled, the intrusion detection circuit 282 would trigger the anti-theft circuit 28 to issue some alarming signal such as a flashing light or a siren by the alarm generator 29. The anti-theft circuit 28 is also connected to a transmission detection circuit 281 which will trigger the alarm generator 29 when the captured images couldn't be transmitted. In the meantime, the anti-theft circuit 28 would also activate the image storage circuit 31 so that the captured images could be saved locally in a storage device and then retrieved later for examination. Additionally, the anti-theft circuit 28 is connected to a voltage detection circuit 280 so that, when there is no electricity from the mains 26, the voltage detection circuit 280 triggers the anti-theft circuit 28 to issue alarms which, in turn, instructs the main circuit board 21 to draw electricity form the battery 27.

The main circuit board 21 is connected to a radio-frequency (RF) transmission circuit 32, which is used to transmit the captured images to any one of the remote control centers 4 via an appropriate wireless air interface. The captured images could also be optionally saved in a local storage as a backup copy. The RF transmission circuit 32 is also connected to the anti-theft circuit 28 so that, when any abnormal condition is detected, the RF transmission circuit 32 is used to transmit alarms to the control center 4.

As such, the remote surveillance device 100 according to the present invention could be employed indoor or outdoor remote monitoring applications with local backup and the capability to guard against power outage and theft.

Figure 5:
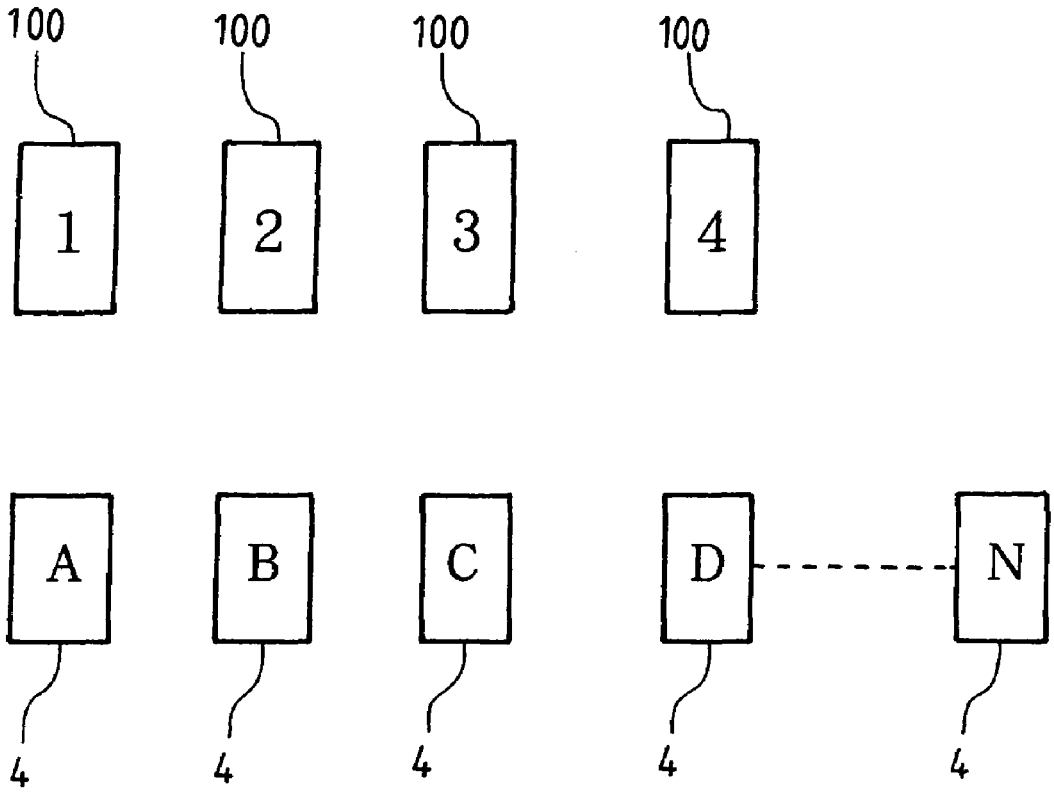
FIG. 5 is a schematic diagram showing multiple remote surveillance devices of the present invention communicating with multiple monitor devices.
Figure 6:
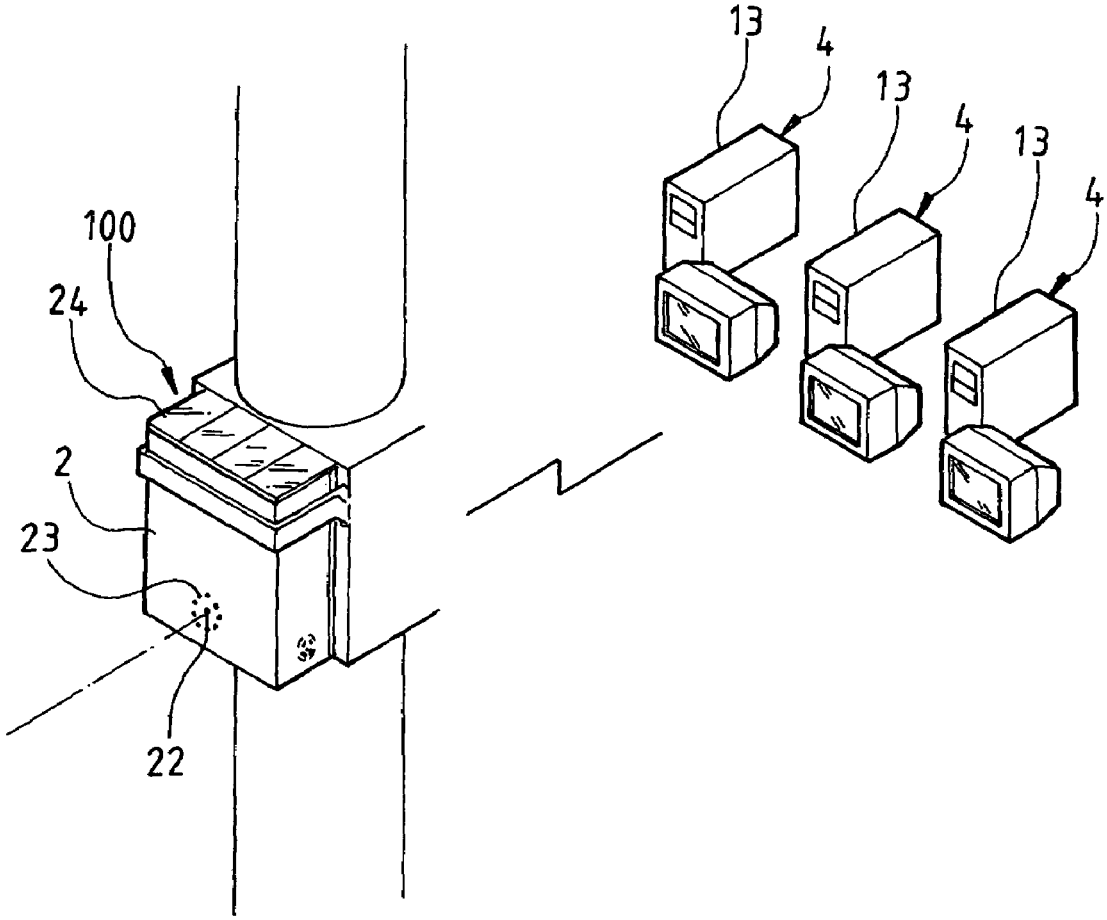
FIG. 6 is a schematic diagram showing an application scenario of the present invention.

As illustrated in FIGS. 5 and 6, multiple remote surveillance devices 100 according to the present invention could be installed at geographically dispersed locations, whose captured images, besides being stored locally in the devices 100, could be transmitted to control centers 4 also located at various different places. The remote surveillance device 100 could choose a single control center 4, or multiple control centers 4, as the destination of its transmission. Similarly, the monitor device 13 of a control center 4 could receive images from multiple remote surveillance devices 100. The wireless air interface could be one that adopts GPRS, GSM, or similar mobile communications protocols.

In summary, the present invention has the following advantages compared to the conventional surveillance devices. First, the housing of the present invention is of a common style, which is suitable and easy for installation at various locations and heights. The housing could even be camouflaged if required to collect information in secrecy. Second, by using rugged material for the housing, the present invention could withstand man-made damages and all weather conditions. Third, as all components are hidden inside the rugged housing, the present invention is not required to be installed at high places to escape human reach and therefore does not require expensive telescope cameras. The present invention could be equipped with cheaper ordinary cameras and installed at locations about human height. The capture images are even clearer than conventional surveillance devices. Fourth, the IR LEDs provide the required or auxiliary lighting when there is not enough lighting or even at night. Fifth, the internal battery and solar panel allow the present invention to continue its operation even when electricity supply is disrupted. Sixth, when the transmission to the control center fails, the present invention continues its surveillance by saving the captured images locally, such that later when the transmission is restored, the saved images could be retrieved for examination. Seventh, whenever an abnormal condition such as theft, power outage, damage, etc. occurs, an alarm is triggered to scare off the malicious person, and is sent to the control center to notify the repair personnel. Eighth, the all-in-one design and wireless capability of the present invention significantly simplify its installation, and facilitate the construction of a networked surveillance system involving multiple control centers.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A remote surveillance device comprising:

a housing;

a main circuit board located inside said housing;

a camera configured on said main circuit board having a plurality of infra-red LEDs around said camera;

a solar panel configured on top of said housing;

a voltage switch circuit connected to said solar panel, a mains, and said main circuit board;

an anti-theft circuit connected to said main circuit board and an alarm generator;

an image storage circuit connected to said main circuit board; and a radio-frequency transmission circuit connected to said main circuit board and said anti-theft circuit;

wherein said remote surveillance device is operable from an internal battery during power outage, saves captured images locally, transmits captured images to at least a remote control center, generates alarm and notifies said control center whenever an abnormal condition occurs; and said infra-red LEDs provide lighting for continuous image capturing when there is not enough lighting.

2. The remote surveillance device according to claim 1, wherein said anti-theft circuit is connected to an intrusion detection circuit which triggers said anti-theft circuit to generate alarms when said housing is forcedly opened, or dismantled.

* * * * *